US009974141B2

(12) United States Patent
Simonian et al.

(10) Patent No.: US 9,974,141 B2
(45) Date of Patent: May 15, 2018

(54) LIGHTING SYSTEM WITH SENSOR FEEDBACK

(71) Applicant: Telelumen, LLC, Saratoga, CA (US)

(72) Inventors: Dmitri Simonian, Sunnyvale, CA (US); Steven Paolini, Saratoga, CA (US)

(73) Assignee: Telelumen, LLC, Saratoga, CA (US)

( * ) Notice: Subject to any disclaimer, the term of this patent is extended or adjusted under 35 U.S.C. 154(b) by 144 days.

(21) Appl. No.: 15/062,080

(22) Filed: Mar. 5, 2016

(65) Prior Publication Data

US 2016/0192454 A1 Jun. 30, 2016

Related U.S. Application Data

(60) Continuation of application No. 13/475,851, filed on May 18, 2012, now abandoned, and a continuation-in-part of application No. 14/682,391, filed on Apr. 9, 2015, now Pat. No. 9,534,956, which is a division of application No. 13/892,042, filed on May 10, 2013, now Pat. No. 9,028,094, which is a (Continued)

(51) Int. Cl.
*F21V 33/00* (2006.01)
*H05B 33/08* (2006.01)

(52) U.S. Cl.
CPC ..... *H05B 33/0869* (2013.01); *H05B 33/0872* (2013.01)

(58) Field of Classification Search
CPC .... H05B 37/02; H05B 37/03; H05B 33/0869; H05B 33/0842; H05B 33/0854; H05B 33/0857; F21V 9/00; F21Y 2113/005
See application file for complete search history.

(56) References Cited

U.S. PATENT DOCUMENTS 5,924,784 A 7/1999 Chliwnyj et al.
6,525,855 B1 2/2003 Westbrook et al.
(Continued)

FOREIGN PATENT DOCUMENTS

EP 1750428 A2 7/2007
EP 1876385 A2 9/2008
(Continued)

OTHER PUBLICATIONS

Paolini, Steve, "Solid State Luminaires and Illumination Content" Strategies in Light Conference, 11th Annual Conference, Santa Clara, California, pp. 1-20 (Feb. 10-12, 2010).
(Continued)

*Primary Examiner* — Elmito Breval
*Assistant Examiner* — Meghan Ulanday
(74) *Attorney, Agent, or Firm* — David Millers

(57) ABSTRACT

A lighting system includes multiple light sources, a sensing unit, and a control system. The light sources have different emission spectra, and the sensing unit is configured to measure a spectral content of light. The control system may be configured to use measurements from the sensing unit to select respective intensities for emissions from the light sources and then independently control the light sources to emit the respective intensities. In particular, the control system can select and render a spectral distribution selected based on the light reflected from objects that are being illuminated or render a spectral distribution to supplement light from other light sources and achieve a lighting objective.

24 Claims, 7 Drawing Sheets

Related U.S. Application Data division of application No. 13/105,837, filed on May 11, 2011, now Pat. No. 8,469,547, which is a division of application No. 12/215,463, filed on Jun. 26, 2008, now Pat. No. 8,021,021.

(56) References Cited

U.S. PATENT DOCUMENTS

| | | | | |
|---|---|---|---|---|
| 6,683,423 | B2 | 1/2004 | Cunningham | |
| 6,890,085 | B2 | 5/2005 | Hacker | |
| 6,965,205 | B2 | 11/2005 | Piepgras et al. | |
| 7,023,543 | B2 | 4/2006 | Cunningham | |
| 7,046,160 | B2 | 5/2006 | Pederson et al. | |
| 7,119,498 | B2 | 10/2006 | Baldwin et al. | |
| 7,125,143 | B2 | 10/2006 | Hacker | |
| 7,178,941 | B2 | 2/2007 | Roberge | |
| 7,202,613 | B2 | 4/2007 | Morgan et al. | |
| 7,221,104 | B2 * | 5/2007 | Lys | A61N 5/0616 315/291 |
| 7,227,634 | B2 | 6/2007 | Cunningham | |
| 7,529,004 | B2 | 5/2009 | Debevec et al. | |
| 9,217,247 | B2 | 12/2015 | Behling et al. | |
| 2003/0107887 | A1 | 6/2003 | Eberl | |
| 2004/0105261 | A1 | 6/2004 | Ducharme et al. | |
| 2004/0218387 | A1 | 11/2004 | Gerlach | |
| 2005/0046850 | A1 | 3/2005 | Chow | |
| 2006/0006820 | A1 | 1/2006 | Roseman et al. | |
| 2006/0008119 | A1 | 1/2006 | Chang et al. | |
| 2006/0114440 | A1 * | 6/2006 | Sekigawa | G03F 7/2057 355/69 |
| 2006/0176693 | A1 | 8/2006 | Walter et al. | |
| 2007/0097252 | A1 | 5/2007 | Silverstein | |
| 2007/0108846 | A1 | 5/2007 | Ashdown | |
| 2007/0174773 | A1 | 7/2007 | Abernathy, Jr. et al. | |
| 2009/0323321 | A1 * | 12/2009 | Paolini | H05B 33/086 362/231 |
| 2012/0123637 | A1 * | 5/2012 | Funayama | G01J 3/02 701/36 |

FOREIGN PATENT DOCUMENTS

| | | | |
|---|---|---|---|
| GB | 2409287 | A | 6/2005 |
| JP | 2003517705 | A | 5/2003 |
| JP | 2005509245 | A | 4/2005 |
| WO | WO0106316 | A1 | 1/2001 |
| WO | WO0136864 | A2 | 5/2001 |
| WO | WO02091805 | A2 | 11/2002 |
| WO | WO03067934 | A2 | 8/2003 |

OTHER PUBLICATIONS

Paolini, Steve, "Exploiting the Visible Spectrum Progress and Future" Strategies in Light Conference, 11th Annual Conference, Santa Clara, California, pp. 1-18 (Feb. 10-12, 2010).

Paolini, Steven, "Solid state lighting in buildings: status and future", Tenth Annual Conference on Solid State Lighting, San Diego, California, SPIE Proceedings, vol. 7784, 77840K, pp. 1-10 (Aug. 18, 2010).

Paolini, Steve, "Solid-State Lighting—Demystifying the Pieces and Assembling the Future", Strategies in Light Co1 nference, 12th Annual Conference, Santa Clara, California, pp. 1-39 (Feb. 22-24, 2011).

Won, Euntae, Samsung Electronics "SG VLC Project Draft 5C" IEEEP802.15 15-08-0667-01-0v1c, Sep. 2008, pp. 1-3.

* cited by examiner

LIGHTING SYSTEM WITH SENSOR FEEDBACK

CROSS-REFERENCE TO RELATED APPLICATIONS

This patent document is a continuation and claims benefit of the earlier filing date of U.S. patent application Ser. No. 13/475,851, filed May 18, 2012 and is a continuation-in-part and claims benefit of the priority date of U.S. patent application Ser. No. 14/682,391, filed Apr. 9, 2015, which claims the priority of U.S. patent application Ser. No. 13/892,042, filed May 10, 2013, now U.S. Pat. No. 9,028,094, which claims the priority of U.S. patent application Ser. No. 13/105,837, filed May 11, 2011, now U.S. Pat. No. 8,469,547, which claims the priority of U.S. patent application Ser. No. 12/215,463, filed Jun. 26, 2008, now U.S. Pat. No. 8,021,021, all of which are hereby incorporated by reference in their entirety.

BACKGROUND

Lighting systems have employed switching mechanisms that respond to signals from sensors. For example, a switching system for a light may include a light sensor or a motion sensor. Such systems can then automatically switch on the light when darkness or motion is detected and switch off the light when ambient lighting or inactivity persists for a period of time. Sensors can also be used in high capability lighting systems such as described in U.S. Pat. No. 8,021,021, entitled "Authoring, Recording and Replication of Lighting," which is hereby incorporated by reference in its entirety. For example, a high capability lighting system that uses multiple color channels to produce programmable emission spectra may employ a sensor that measures the light emitted from the color channels, and such measurements may be used for calibration of the color channels.

SUMMARY

In accordance with an aspect of the invention, a luminaire having a controllable emission spectrum can use a light sensing unit that senses spectral content of light in an illuminated environment or reflected from an object. The illuminated environment may, for example, be lit by light from the luminaire and light from additional artificial or natural light sources. The environment may also contain a variety of objects that reflect light with spectral characteristic of the objects and the environmental lighting. A control system can adjust the emission spectrum of the luminaire based on measurements from the light sensing system. For example, the control system can evaluate a measurement from the sensing unit and adjust the emission spectrum of the luminaire as needed to achieve one or more lighting objectives. The lighting objectives can be associated with a specific object or collection of objects in the environment and associated with a desired appearance characteristic of the object or objects, or the lighting objective can be associated with general characteristic of the combined lighting in a specific area or environment as a whole. In one configuration, the characteristics (e.g., intensity, spectral content, spatial distribution, and evolution over time) of lighting from the luminaire are selected according to sensed light reflected from an object, and the selection may particularly provide an aesthetic effect for the object. In another configuration, the characteristics of light emitted from a light source are selected to supplement or augment light from other sources to provide an environment with a desired combined lighting.

One specific embodiment of the invention is a lighting system that includes multiple light sources, a sensing unit, and a control system coupled to the sensing unit and the light sources. The light sources respectively have different emission spectra, and the sensing unit is configured to measure a spectral content of lighting. The control system may be configured to use a measurement from the sensing unit to select respective intensities for emissions from the light sources and to independently control the light sources to emit the respective intensities.

Another specific embodiment of the invention is a lighting method that includes measuring a spectral content of light reflected from an object. The measurement of the spectral content can then be used in selecting a spectral distribution, and the operating parameters of a luminaire can be selected to illuminate a scene with light having the spectral distribution selected.

BRIEF DESCRIPTION OF THE DRAWINGS

Use of the same reference symbols in different figures indicates similar or identical items.

DETAILED DESCRIPTION

A lighting system such as a multi-channel luminaire capable of rendering a range of spectral distributions employs a light sensing unit to sense one or more characteristics of an illuminated environment. The luminaire can then adjust or select the emitted spectral distribution according to the sensed environmental lighting characteristic, e.g., to achieve a desired lighting objective. In one process that can be performed with such a luminaire, a spectral distribution or illumination data representing a spectral distribution can be selected according to a sensed light characteristic, and the luminaire can be operated to emit the selected spectral distribution. For example, spectral content of the combined lighting in an environment can be sensed, and the luminaire can select and emit a spectral distribution that complements or supplements other light sources in the environment so that the combined lighting achieves a desired lighting objective. Alternatively, light reflected from objects can be sensed, and the lighting can be selected and generated to achieve an aesthetic objective for lighting of the objects.

Figure 1:
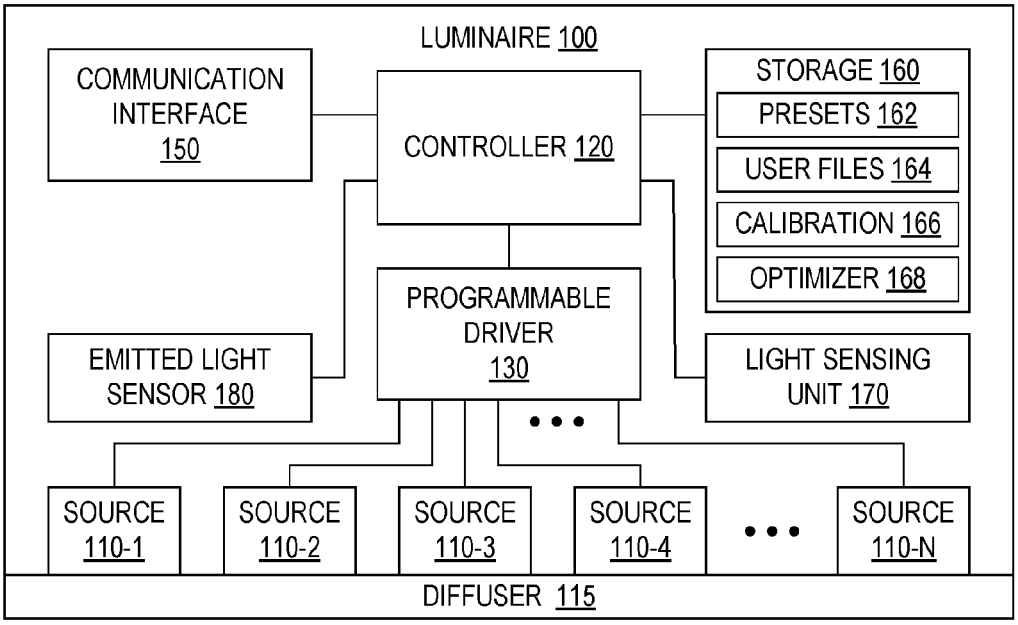
FIG. 1 shows is a block diagram of a luminaire including a light sensing unit that provides feedback to a control system.

FIG. 1 illustrates an example of a multi-channel luminaire 100 having a variable and controllable emitted spectral distribution. In the illustrated example, luminaire 100 contains multiple light sources 110-1 to 110-N, generically referred to herein as light sources 110. The different light sources 110-1 to 110-N respectively have different emission spectra and collectively can be configured and operated to emit a desired spectral power distribution for emitted light. For example, each light source 110 may include multiple light elements, e.g., multiple light emitting diodes (LEDs), and different light sources 110 may respectively contain different types of light elements that have different respective light emission spectra. The emission spectrum of luminaire 100 covers a range of wavelengths that generally depends on the types of light sources 110 employed and may, for example, cover a range including most of the visible spectrum and possibly extend to ultraviolet or infrared wavelengths. The number N of types of light sources 110-1 to 110-N required to cover a desired range of wavelengths generally depends on the range and the widths of the emitted spectra of light sources 110-1 to 110-N. In an exemplary embodiment, light sources 110-1 to 110-N have different colors (e.g., from 4 to 50 different colors) with peak emission wavelengths in a range from about 400 nm to about 700 nm, and the peak emission wavelengths of light sources 110-1 to 110-N can be separated by steps that depend on the shapes of the respective spectral distributions of light sources. For example, steps of about 5 nm to about 50 nm to provide desirable spectral resolution and continuously cover the visible spectrum using direct emission LEDs having single-peak spectra with FWHM of about 15 to 35 nm. Phosphor-converted LEDs have wider spectral distributions, i.e., larger FWHM, so that few light sources may be needed if some or all of light sources 110-1 to 110-N are phosphor-converted LEDs.

LEDs having different peak emission wavelengths can be produced using different materials or structures. The two currently dominant LED material systems respectively employ InGaN and AlInGaP. Other types of light sources can be used in combination with or instead of LEDs in one or more of light sources 110-1 to 110-N. For example, phosphors can be combined with LEDs in one or more light sources 110-1 to 110-N to convert direct LED emissions to the desired wavelengths through fluorescence. In general, LEDs of different wavelengths and generally different types of light sources have different levels of energy efficiency, and the number of light elements of each type (i.e., having the same or very similar spectral power distributions) may differ to enable a more uniform maximum intensity across the spectrum. A light source 110 may also include multiple types of light elements, e.g., different types of LEDs, that may have different emission spectra, but the different light elements can be operated as a group to give a light source 110 an emission spectrum that is a combination of the emission spectra of the different types of light elements.

Figure 2A:
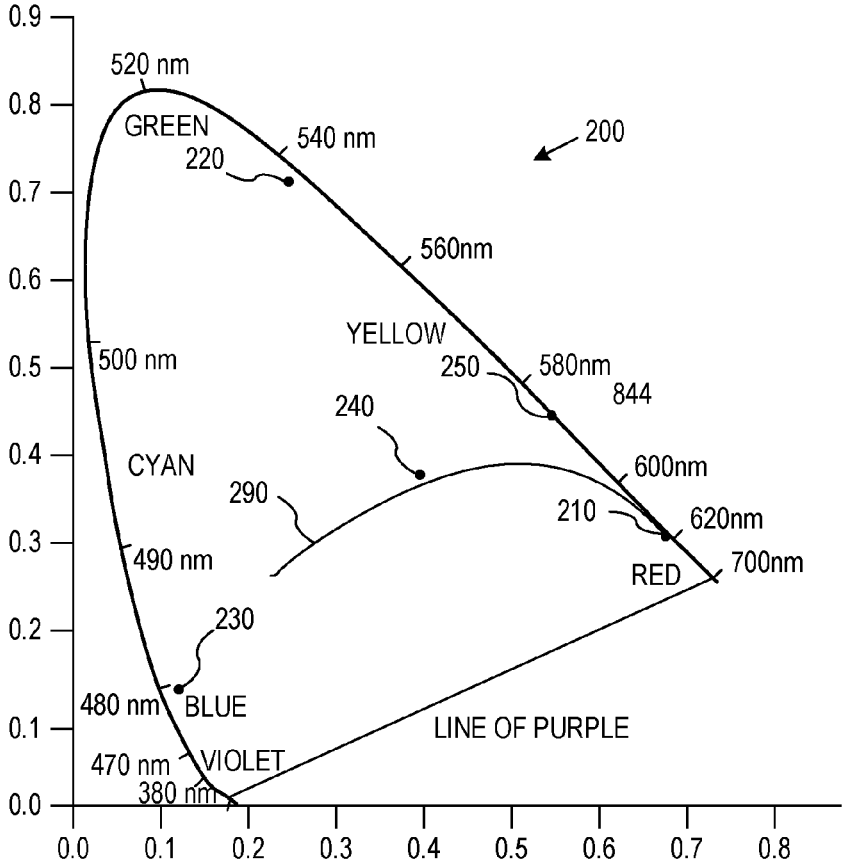
FIG. 2A shows a CIE color chart illustrating the colors of five light sources that a 5-channel luminaire can use to render a selected spectral distribution.

The illumination requirements, e.g., intensity range, spectral range, range of available color temperatures, gamut, and color rendering, of luminaire 100 controls the specific choice of the number light sources 110, the types of LEDs or other lighting elements in light sources 110, and the number of LEDs or lighting elements of each type. For example, luminaire 100 may need to be able to emit a sufficiently accurate approximation of white light with any color temperature from a pre-selected range or any color temperature from a discrete set of color temperatures. If the required range of color temperatures is between about 2400° K and 7000° K, an exemplary embodiment of light sources 110-1 to 110-N may include: a set of twenty-two direct red 625-nm LEDs; a set of six direct green 520-nm LEDs; a set of eight direct blue 472-nm LEDs; a set of twenty phosphor converted blue LEDs with a correlated color temperature of about 6200° K, and a set of twenty-four strongly phosphor-converted blue LEDs. "Strongly converted" in this context refers to phosphor conversion that consumes a large fraction of blue photons, e.g., above 80% or more preferably above 95%, from the blue LED. FIG. 2A shows a CIE color chart containing the color points 210, 220, 230, 240, and 250 of the five light sources 110 in the exemplary embodiment of the invention, wherein colors 210, 220, and 230 respectively correspond to direct red, green, and colors 240 and 250 correspond to neutral white and phosphor-converted amber LEDs. An alternative embodiment of light sources 110-1 to 110-N includes: all or a subset of the following: a set of direct red 625-nm LEDs; a set of direct green 520-nm LEDs, a set of direct blue 472-nm LEDs, a set of phosphor converted yellow-green LEDs with a color point above the Planckian locus 290, a set of phosphor-converted cool white LEDs with a correlated color temperature of about 6000K, and a set of phosphor-converted amber LEDs. Peak wavelengths are indicated for illustration purposes only. For example, a red 625 nm LED may be substituted by a red LED with a peak wavelength between 615 nm and 660 nm.

A diffuser 115 as shown in FIG. 1 may include an optical device such as a frosted plate of a transparent material that mix light from light sources 110-1 to 110-N to provide more spatially uniform lighting that combines light from all light sources 110-1 to 110-N. Additionally, the lighting elements of light sources 110-1 to 110-N can be mixed or scattered in different locations within an array for better spatial uniformity of the spectrum of emitted light.

Luminaire 100 further contains a controller 120 that processes illumination data and operates a programmable driver 130 to individually adjust the intensity of light emitted from each of light sources 110-1 to 110-N. In particular, the respective intensities emitted from light sources 110-1 to 110-N can be independently adjusted to provide lighting that approximates any desired spectral power distribution over the range of wavelengths of light sources 110-1 to 110-N. When each light source 110 includes a set of serially connected LEDs, driver 130 can generally dim each of light sources 110-1 to 110-N to almost any desired extent by pulse width modulation (PWM) and/or amplitude modulation (AM) of the respective drive currents of the LEDs.

In one specific embodiment as described above, luminaire 100 contains five different light sources 110 with different emission spectra or colors, and programmable driver 130 includes five independent color channels for control of the respective intensities of light emitted from light sources 110. Each color channel can, for example, control forward current through a set of serially connected LEDs. The average intensity and color point of light produced by a color channel will then depend on the magnitude and duty cycle drive of the current that programmable driver 130 provides for the channel. Luminaire 100 can thus provide light emissions with huge variety of different emission spectra and can approximate or render any emission spectrum. In particular, the five light source described for the exemplary embodiment can render white light with a color temperatures between 2400K and 7000K and a color quality scale (CQS) score Qa score above 85. The National Institute of Standards and Technology promulgates the CQS as quantification of the accuracy of a color rendering in such a way that "perfect" rendering score is 100.

Figure 2B:
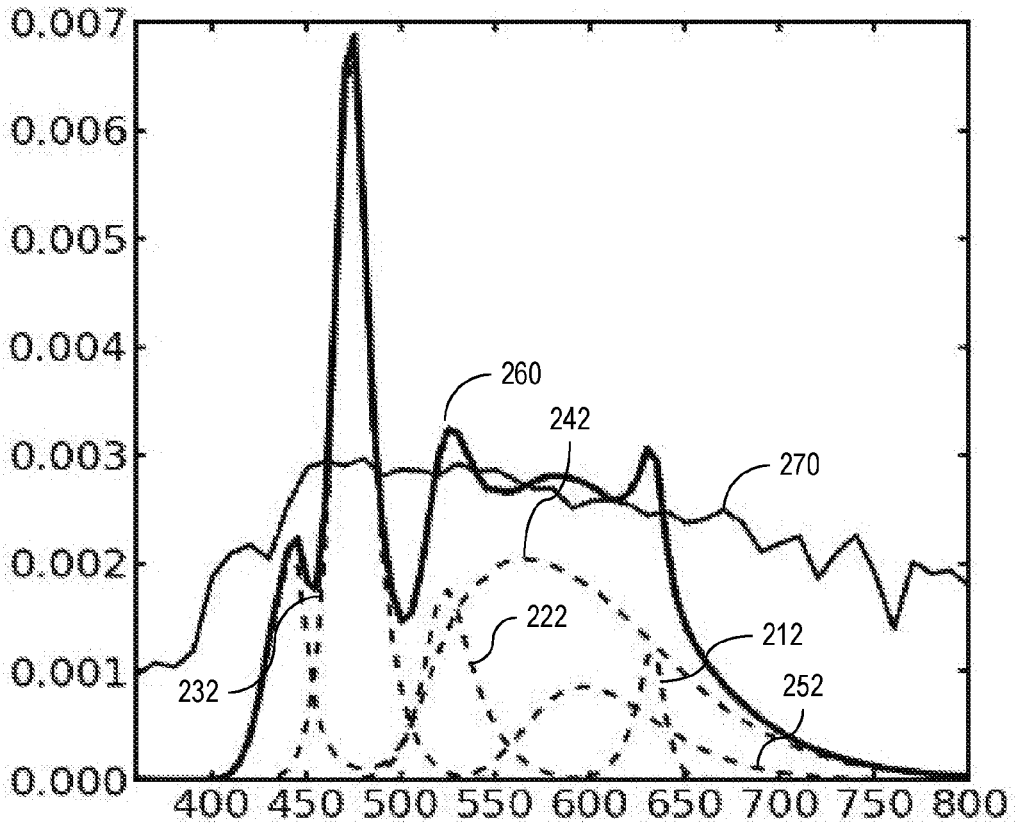
FIG. 2B illustrates a rendering of white light having a color temperature of 5800° K using the light sources of FIG. 2A.

FIG. 2B illustrates rendering of white light having a color temperature of 5800° K using the five light sources shown in FIG. 2A. In FIG. 2B, a synthesized spectrum 260, which contains spectral contributions 212, 222, 232, 242, and 252 from respective light source 210, 222, 230, 240, and 250, approximates a target spectrum 270 over wavelength range from about 420 nm to about 660 nm.

Luminaire 100 may employ illumination data to represent a fixed spectral distribution of light, a spatial distribution of light, or light having a spectral or spatial distribution that varies over time. For example, as described in U.S. patent application Ser. No. 13/046,578, entitled "Luminaire System," which is hereby incorporated by reference in its entirety, describes how illumination data may be formatted as a script for controller 120 and may include executable code that controls the evolution of lighting. The illumination data may be available from an external source through a communication interface 150 or internally from a storage system 160. For example, the illumination data can be streamed or input into luminaire 100 and controller 120 through a communication interface 150. In an exemplary embodiment, communication interface 150 connects luminaire 100 to a network that may include similar luminaires or control devices and can further be part of a user interface that allows a user to control luminaire 100, for example, to select lighting conditions for an environment containing luminaire 100. Storage system 160 may be any type of system capable of storing information that controller 120 can access. Such systems include but are not limited to volatile or non-volatile IC memory such as DRAM or Flash memory and readers for removable media such as magnetic disks, optical disks, or Flash drives.

FIG. 1 illustrates storage 160 as containing two types of illumination data including presets 162 and user files 164. Presets 162 may be factory installed illumination data files that represent default lighting or lighting that may be useful to a wide number of users. Presets may be time-dependent. The presets might include, for example, the spectra of common natural light source such as the sun at noon on a cloudless summer day or a full moon, the evolution of sunlight at sunrise, the spectra of flame based light sources such as candles or a camp fire, the spectra of common electrical light sources such as incandescent or fluorescent lights, and the spectra that provide luminaire 100 with optimal energy efficiency for human vision over a range of different intensities. Another example of preset illumination data for luminaire 100 represents white light of a desired color temperature. Illuminations associated with a range of color temperatures could similarly be represented using illumination data.

User files 164 are illumination data that a user has chosen to store in luminaire 100. User files 164 can include illumination data of the same types as mentioned for the presets but additionally include illumination data that are of particular interest for a specific user. For example, an individual may load into storage 160 illumination data that provides lighting having spectral content and time variation that is optimized for their sleep cycle or the sleep cycle of their child. A researcher may load into storage 160 illumination data that create lighting that provides the desired spectral content for an experiment or lighting that optimizes the growth of particular plants or organisms. User files 164 may also include a light track that is synchronized with video content, to create a time-varying lighting ambiance for a movie or a video game.

Illumination data could have a variety of different file formats suitable for representing the desired lighting. A static spectral distribution, for example, may be simply represented using a set of samples corresponding to a set of different wavelengths of light. Alternatively, a static spectral distribution could be represented by the coefficients of a particular transform, e.g., Fourier transform, of the spectral distribution. Further information in the illumination data could represent how the spectral distribution changes with time or absolute intensity. The illumination data could further include positional or directional information to indicate spatial variations in the spectrum and intensity of lighting, particularly when luminaire 100 is used with other lighting fixtures to illuminate a room or other environment.

Luminaire 100 further includes a light sensing unit 170 for sensing light in an environment that may be lit by luminaire 100 and possibly by other light sources that may or may not have adjustable lighting characteristics. Light sensing unit 170 may, for example, be a spectrometer, or a plurality of filtered photodetectors, or a camera and may include optical elements that are positioned in proximity to light sources 110-1 to 110-N or away from light sources 110-1 to 110-N and may communicate with luminaire 100 or particularly controller 120 through a wired or wireless connection. In the present context, "light sensing" refers to measuring a physical, spectral, radiometric, or a photometric parameter of illumination or the reflectance properties of a scene or environment. For example, light sensing unit 170 could include a colorimeter that senses color by measuring CIE color coordinates of an illuminated object in the environment. Light sensing unit 170 could also include a photodetector array or a spectrometer to measure spectral intensity of light coming from an object or of ambient light.

An emitted light sensor 180 may be used to particularly measure the light emitted by luminaire 100. This measurement may differ from the measurement of light sensing unit 170 in that emitted light sensor 180 may be configured to isolate and measure light from light sources 110-1 to 110-N, while light sensing unit measures light the environment of luminaire 100, which may include light from luminaire 100. Emitted light sensor 180 may be particularly useful for calibration of luminaire 100 or for observing or monitoring the performance of light sources 110. Alternatively, one light sensing unit 170 or 180 can perform both environmental light sensing and emitted light sensing (if desired).

In accordance with an aspect of the current invention, the illumination data may indicate one or more lighting objective to be met, as opposed to just a fixed spectral distribution to be emitted by luminaire 100. When controller 120 decodes the illumination data that a user selects for operation of luminaire 100, controller 120 can use light sensing unit 170 to measure the actual lighting in an environment and take action, e.g., adjust the spectral distribution of emitted light based on the measurement.

Controller 120 can further employ data or code from multiple sources in order to determine the correct programming of driver 130. For example, controller 120 can interpolate between samples provided in illumination data being decoded when the peak wavelengths emitted from light sources 110-1 to 110-N differ from wavelengths represented in the illumination data being decoded. Calibration data 166, which may be factory set in storage system 160, can indicate the suitable metrics of light measured from light sources 110-1 to 110-N dependence on drive current, temperature, or other factors. For each light source 110, controller 120 can then use calibration data 166 and temperature data to determine the drive signals needed for respective color channels to produce the required contribution to the spectral distribution represented in the selected illumination data. Internal light sensor 180 can be employed to monitor the emitted light from light sources 110-1 to 110-N to allow controller 120 to adapt the calculation of the required drive signals according to changes in performance that that result from aging or use.

Luminaire 100, which can produce virtually any illumination spectral power distributions within the intensity limits of the light sources 110-1 to 110-N, can be used with other similar luminaires to produce desired spatial pattern in lighting. The spatial pattern of the lighting may be subject to temporal variations. For example, lighting that reproduces the path of solar illumination from dawn to dusk would include spatial, spectral, and intensity variations over the course of a day. A system implementing desired spatial, spectral, and intensity patterns for lighting could be employed, for example, in scene lighting or home lighting.

Controller 120 may also execute an optimizing module 168 to synthesize illumination data based on measurements from light sensing unit 170 and on a target spectral power distribution that may be provided in illumination data. Optimizing module 168 may, for example, output a set of calculated channel currents such that, when these currents are sent through light sources 110-1 to 110-N, the emission spectrum has the color point equal to that of the default white illumination of the pre-selected color temperature, but with such color-rendering properties that the "important" objects in the scene appear more saturated. Optimizing module 168 may supply required currents for each channel to programmable drivers 130, which output the required current to each color channel, synthesizing the required illumination.

Figure 3:
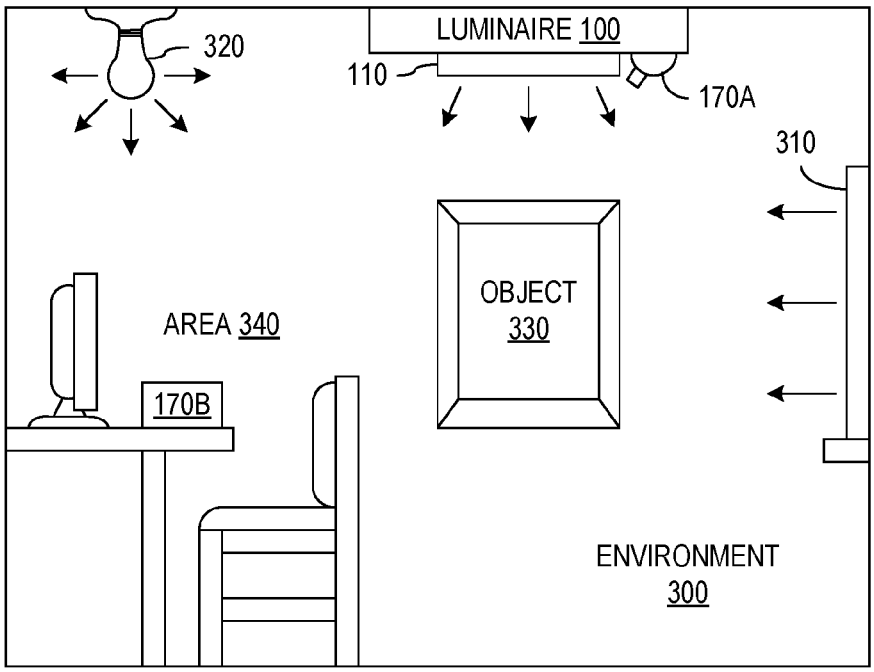
FIG. 3 shows an environment including a luminaire with a light sensing unit.

FIG. 3 conceptually illustrates a deployment of luminaire 100 of FIG. 1 in an environment 300 such a room or other living space or an outdoor area. Luminaire 100 may particularly be positioned to illuminate at least a portion of environment 300, but environment 100 may also include natural lighting 310 such as the light from a window or artificial lighting 320 such as light from traditional incandescent or fluorescent light fixtures or from additional high-capability luminaires. As noted above, luminaire 100 may employ a light sensing unit to sense light reflected from a specific object 330 lit by luminaire 100 or the light in an area 340 of the environment 300. FIG. 3 shows two sensing units. A sensing unit 170A is adjacent to light sources 110 and may be incorporated in the main body of luminaire 100, and a sensing unit 170B component includes components that are separated from light sources 110. Sensing units 170A and 170B are sometimes referred to generically as sensing unit 170, and in general, sensing units 170A and 170B can be used interchangeably for the same functions.

Figure 4:
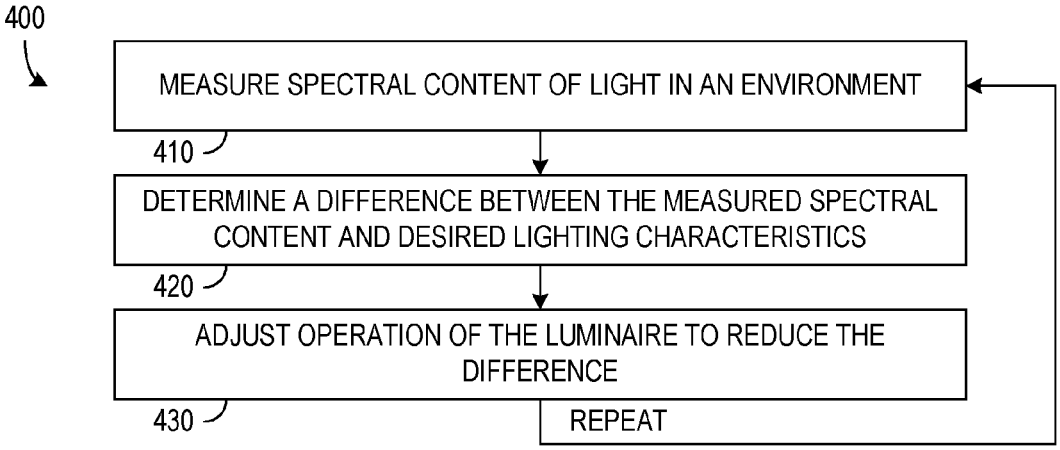
FIG. 4 is a flow diagram of a process of using a luminaire with a light sensing unit to provide combined lighting meeting a lighting objective.

FIG. 4 is a flow diagram of an exemplary process 400 for operating for luminaire 100 in environment 300 to supplement existing lighting, e.g., supplement light from natural illumination 310 and other artificial light sources 320 so that lighting in area 340 achieves a desired lighting objective. More generally, any number of lighting objectives could be selected and prioritized to form a goal matrix that would be used in an autonomous way to optimize the light source to a particular scene. One example of a lighting objective is to light a workspace or area 340 with light having a desired color temperature. In step 410, measuring unit 170 measures the spectral distribution of the lighting in area 340. This lighting as noted above may include contributions from luminaire 100, natural light sources 310, and artificial light sources 320. Luminaire 100 can then compare the measured spectral distribution with a target spectral distribution, e.g., a spectral distribution associated with the desired color temperature. More specifically, controller 120 in luminaire 100 may execute a script that identifies the target spectral distribution, so that controller 120 can calculate a difference between the measured and target spectral distributions. In step 430, luminaire 100, e.g., controller 120 executing appropriate program instructions, can determine an adjustment of the current operating parameters of luminaire 100, e.g., changes in the respective drive currents for light sources 110-1 to 110-N, needed to compensate for the difference. Luminaire 100 in step 430 can then adjust the operation of light sources 110-1 to 110-2, so that lighting in area 340 better approximates the target spectral distribution. This process can be repeated in a continuous manner to adjust for changes in environment 300, e.g., changes in luminaire 100, natural lighting 310, or artificial lighting 320 or changes in the target spectral distribution, for example, if the target spectral distribution evolves over time.

One use of luminaire 100 and process 400 is real-time provision or augmentation of natural lighting in a home or office. For this use, sensing unit 170 may be positioned proximally or remotely relative to light sources 110 and used to measure the spectral characteristics of natural lighting without contributions from luminaire 100. Sensing unit 170 can transmit such measurements of the spectral characteristics of the current natural lighting by wireless or wired communication to luminaire 100, and controller 120 can operate luminaire 100 to synthesize light that approximates the spectral distribution of the measured natural light and has a desired intensity or luminous flux level. As a result, a room or office may appear to be naturally lit but at a user-controlled intensity, rather than an intensity limited by windows or other conduits for natural light. Light sensing unit 170 may measure the natural light every predetermined interval in time, for example, every 10 seconds. Further, multiple sensing units 170 may be positioned at different locales and may send spectral characteristic data to luminaire 100. A user of luminaire 100 could then have the capability of selecting which of the sensing units 170 provides measurement of spectral data, and thus, the illumination synthesized by luminaire 100 will follow the natural light sensed by the selected sensing units 170.

Figure 5:
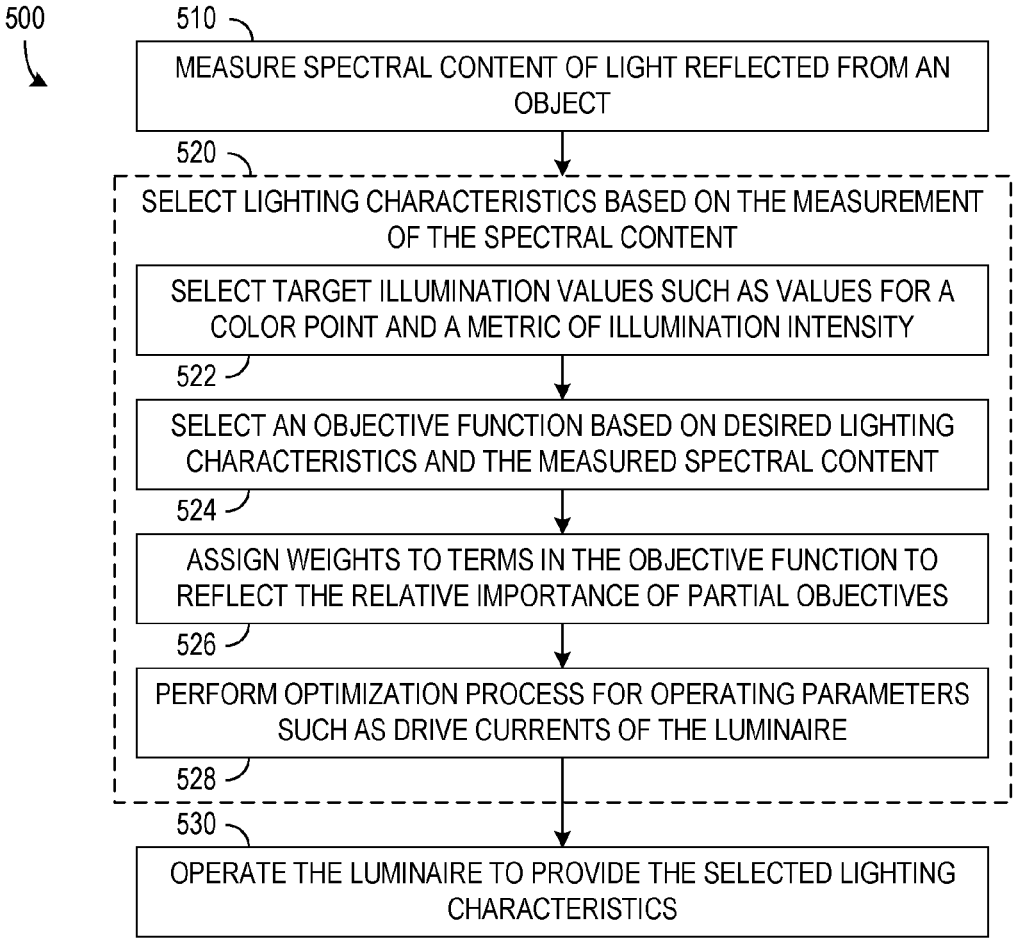
FIG. 5 is a flow diagram of a process for operating a multi-channel luminaire according to characteristics of an environment sensed with a light sensing unit.

FIG. 5 illustrates a process 500 in which luminaire 100 in environment 300 can use measurements from sensing unit 170 during selection of a target spectral distribution. In step 510 of process 500, light sensing unit 170 measures the spectral content of light reflected from an object. The spectral content may be represented by intensities measured at a series of wavelengths by a spectrometer or a set of light detectors. Alternatively, a user may manually place an object or a sequence of objects under the source of a default illumination for measurement by light sensing unit 170, and light sensing unit 170 can provide one or more measurements of user selected object(s) to controller 120. Another alternative for measuring spectral content in step 410 is automatic sensing of scene colors by a camera that captures an entire scene and determines predominant colors automatically, or by a series of detectors that measure color of light reflected by the objects in specific locations within the scene.

Luminaire 100 in step 520 uses the measurement or measurements from light sensing unit 170 to select lighting for the object. In one embodiment, luminaire 100 may be configured to play certain stored scripts in response to associated measurements by light sensing unit 170 when luminaire 100 is used in a particular environment. For example, if luminaire 100 is employed in a store, luminaire 100 can select and change a lighting script based on the nature of the products in an area illuminated by luminaire 100. More particularly, if luminaire 100 is used to light a portion of a produce section in a market, luminaire 100 can be loaded with a set of scripts representing different lighting schemes for different types of produce, and controller 120 can select one of the scripts based on a measurement from light sensing unit 170. In such use, when sensor 170 detects a bright red object, e.g., a tomato, controller 120 can select and execute a script that causes luminaire 100 to emit light that accentuates red and yellow hues. When light sensing unit 170 senses a purple object, e.g., an eggplant, controller 120 may select and play a script causing luminaire 100 to emit a spectrum that makes green and blue hues more saturated. In this manner, luminaire 100 can be loaded with a set of scripts according to the deployment of luminaire 100, and in response to readings from sensing unit 170, luminaire 100 can auto-select from among the loaded script. Similarly, a luminaire can be pre-loaded with lumen scripts for use in fitting rooms, to play different lighting sequences when different garments are worn, or to synthesize a series of lighting conditions that may be typically encountered when wearing a particular garment.

Illumination data or scripts can be selected in step 520 to achieve a variety of different lighting objectives. Some exemplary lighting objectives are to minimize or maximize color saturation of an illuminated object or minimize or maximize color contrast of a particular scene. For example, a commercial product may be illuminated with light that makes the product look more appealing. Conversely, a lighting objective may be to make object (or person) unappealing. For example, to discourage young people from loitering, a light that extenuates acne may have value. Another lighting objective may be control of how much a particular object stands out in a particular setting. For example, lighting may be selected to make a commercial product stand out in a setting or to make one or more other objects blend into the setting.

One fairly general process is selection of scene lighting in response to the color of the scene illuminated by luminaire 100. Given the color, a lighting objective used in selection of lighting can be increasing the saturation of the color. When a scene or environment contains several objects, the colors of the objects may be separately measured. For example, an operator may place objects one-by-one into a light box, allowing sensing unit 170 to individually "read" the color of each object, so that based on the readings, luminaire 100 can select lighting that alters the appearance of the entire set of objects.

Luminaire 100 in step 530 operates to provide the selected lighting. In step 530, the selected lighting may be the light emitted by luminaire 100 or may be a combination of light from luminaire 100 and natural and artificial light sources 310 and 320. In particular, luminaire 100 in step 530 can use process 400 of FIG. 4 to ensure that the combined lighting corresponds the lighting selected in step 520.

One specific embodiment of process 500 can be used to increase or decrease the saturation of a certain perceived color or colors under illumination by a synthesized white light. In this specific embodiment, the goal is to synthesize white light that has a predetermined or target color temperature and luminous flux and also provides high saturation of the reflectance of a particular object characterized by its reflectance measure obtained in step 510. U.S. patent application Ser. No. 13/048,427, entitled "Method of Optimizing Light Output during Light Replication," which is hereby incorporated by reference in its entirety, describes a process using an objective function in a process of optimizing specific characteristics of light from a lumen having multiple color channels. The variables in the objective function may be respective drive currents for the color channels of the luminaire. In FIG. 5, step 520 includes sub-steps 522, 524, 526, and 528 for a specific employing an objective function to determining operating parameters such as drive currents that provide illumination with the selected lighting characteristics. The illustrated implementation of step 520 begins in step 522 with selecting target illumination characteristics by defining the values of color point and of a relevant metric of intensity, for example, luminous flux. The target illumination characteristics selected in step 522 may be dependent on the measured spectral content or independent of the measured spectral content. For example, the intensity of the illumination and the color average color point of the illumination may be a user preference and independent of the measured spectral content. Other target illumination values such as a desired shape of the spectral distribution or particular wavelengths of light to be emphasized in the synthesized illumination may be selected automatically based on the measured spectral content from step 510.

Step 524 selects an objective function based on the target illumination characteristics. The objective function may be based selected to achieve several partial objectives, and each partial objective can be represented by one or more weighted terms. For example, such terms may characterize the deviation of luminous flux of the synthesized spectrum from the target luminous flux and/or the deviation of the color point of the synthesized spectrum from that of a reference light, e.g., from Planckian radiation or daylight having the predetermined target color temperature and flux. The objective function may further comprise weighted terms that characterize mean-square deviation of the synthesized spectral power distribution from a target spectral power distribution. The terms may be defined such that the smaller the deviation, the smaller the value of the corresponding term is. An objective function may further include a weighted term that corresponds to the deviation in La*b* color space of the color of an object of step 510 when illuminated by a synthesized light, from the color of the object when illuminated by the reference light. The term corresponding to deviation in La*b* color space may be defined such that the larger this deviation in the direction away from the white point, the smaller the value of this term is. Many ways of forming an objective function are possible. An exemplary definition of an objective function S with three partial objectives is given by Equation 1. The right side of Equation 1 includes three terms with respective weights $w_1$, $w_2$, and $w_3$ that reflect the relative importance of the partial objectives associated with the respective terms. In Equation 1, the first term depends on trichromaticities X, Y, and Z of the synthesized (s) and reference (t) illumination; the second term is a weighted square of the Euclidean distance between reference spectral power distribution $S_t$ and synthesized spectral power distribution $S_s$; and the last term is the deviation of the color of an object of step 510 when illuminated by a synthesized light ($a_s^*$,$b_s^*$), from the color of this object when illuminated by the reference light ($a_t^*$,$b_t^*$). In particular, which parameters $a_s^*$,$b_s^*$, $a_t^*$,$b_t^*$ are used in Equation 1 may be selected based the spectral content found by measurement in step 510. Synthesized spectral power distribution $S_s$, trichromaticities $X_s$, $Y_s$, and $Z_s$, and parameters $a_s^*$,$b_s^*$ are functions of drive currents $I_0$ to $I_{k-1}$ of k emitters or color channels of the luminaire. Currents $I_0$ to $I_{k-1}$ are variables that may be subject to constraints. For example, no current $I_0$ to $I_{k-1}$ can be higher than the maximum current that the driver in the luminaire is capable of supplying.

$$S(I_0, \ldots, I_{k-1}) = w_1 \frac{(X_s - X_t)^2 + (Y_s - Y_t)^2 + (Z_s - Z_t)^2}{X_t^2 + Y_t^2 + Z_t^2} + w_2 \frac{\|S_s - S_t\|^2}{\|S_t\|^2} + w_3\left(1 - \frac{a_s^* a_t^* + b_s^* b_t^*}{a_t^{*2} + b_t^{*2}}\right) \quad \text{Equation 1}$$

Examination of Equation 1 shows that the first two terms are non-negative and decreasing with a synthesized light approaching the reference white light; while the third term is zero if object rendering with a synthesized light equals that with the reference light, and becomes negative and decreases as the color of an object of step 510 under a synthesized light, deviates from the color of the object under the reference light in the direction away from the white point. Weights $w_1$, $w_2$, and $w_3$ of the terms characterize the importance of partial objectives, and step 526 may set the values of weights $w_1$, $w_2$, and $w_3$, for example, according to according to user preferences or a predetermination of the desired effect. If no special color-rendering properties are desired for the synthesized light, the third weight may be set to 0, and in this case, the spectral power distribution of a synthesized light will converge to approximate that of the reference spectral power distribution $S_t$, e.g., to a Planckian or daylight spectral power distribution. For the exemplary use of the method of FIG. 5, which is the synthesis of white light with special object-dependent lighting characteristics, the weight $w_2$ corresponding to matching of spectral power distributions $S_s$ and $S_t$ may be lower, while the weight $w_3$ corresponding to the color rendering modification objective may be higher. During an iterative optimization process described below these weights $w_1$, $w_2$, and $w_3$ may remain constant or may be adjusted.

An iterative optimization calculation 528 is then performed to minimize the value of the objective function S. Various methods of such minimization may be applied, for example, at each step of the iteration, current $I_n$ of the n-th emitter may be allowed to vary while all other currents are kept fixed. The n-th emitter current $I_n$ that corresponds to the minimum of the objective function S under the constraint of all other currents being held constant is then calculated. If this current value is within the allowed range, it is accepted, otherwise, it is coerced to the allowed range. At the next step the n+1-th emitter current $I_{n\pm1}$ is allowed to vary while the n-th emitter current is fixed at its new value determined at the previous step. The iterative calculation succeeds when an acceptable solution has been found within the range of allowed values for emitter currents. The acceptability criteria are usually defined as a maximum allowed deviation of luminous flux and color point of the synthesized light from those of the reference light.

In a case of a luminaire that comprises a small number of independently-controllable emitters, for example, 5 or 6 emitters, a different approach may be taken for optimization process 528. Instead of running optimization process 528 to find an optimal solution, all valid solutions may be examined. A valid solution may be defined as such a set of emitter currents within the allowed range of current values which create a synthesized spectrum with substantially matches the illumination intensity and color point of the reference spectrum. In the case of 5 emitters this problem is particularly tractable, as the condition of matching 3 parameters (intensity, and a point in a two-dimensional color space) imposes such a constraint on emitter currents that only two currents may be independently set, while the other three can be easily calculated from the two set currents. A 5-emitter system will thus have two degrees of freedom. Taking two emitters and varying their currents in the allowed range with a certain step, a set of valid solutions will be found. For example, values of the current of an emitter may be between 10 mA and 0.5 A in 10 mA steps. With such step size and range, in a 5-emitter luminaire, a total of 2500 current combinations need to be examined. A subset of these will be valid, and among this subset, the best solution can be found. The best solution may have the most saturated rendering of a desired object color, according the metric discussed above.

Figure 6A:
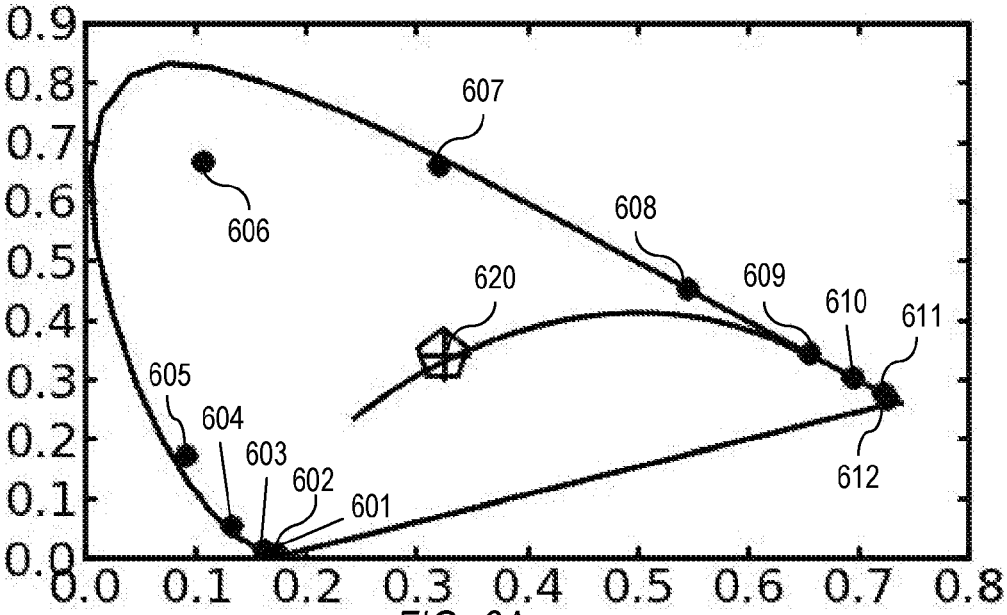
FIG. 6A shows a CIE color chart illustrating the colors of twelve light sources that a 12-channel luminaire can use to render a selected spectral distribution.
Figure 6B:
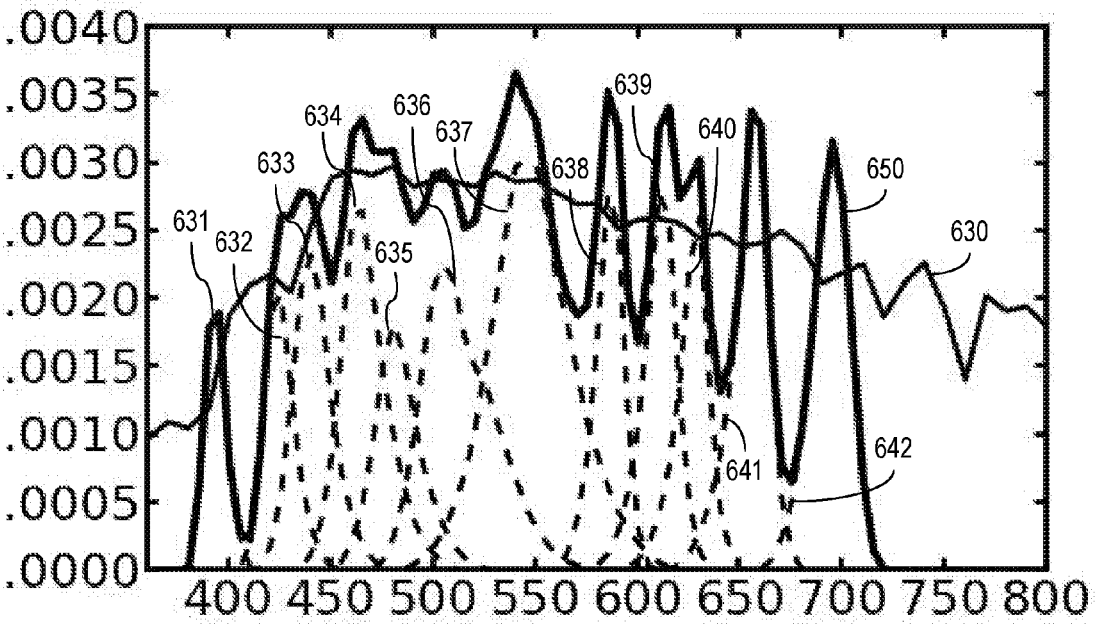
FIG. 6B shows a target spectral power distribution provided by 5800° K daylight and a spectral power distribution synthesized using twelve independently controllable light sources.

FIG. 6A shows a CIE chromaticity diagram containing color points 601 to 612 respectively corresponding to twelve light channels of a multi-channel luminaire. A luminaire containing light emission channels having the illustrated color points 601 to 612 can produce having a wide range of colors and spectral distributions corresponding to each of those colors. As an example, a goal for the illumination from a multi-channel luminaire may be that collective emissions from the color channels of the luminaire produce light have a color point 620 that corresponds to 5800° K daylight. FIG. 6B contains a plot 630 of the spectral distribution of daylight over a wavelength range from about 350 nm to about 800 nm. The 12-channel luminaire can be operated to independently control the intensities emitted by the twelve light channels to emit component spectral distributions 631 to 642 that together create a combined spectral distribution 650 that that approximates daylight spectral distribution 630 over a wavelength range from about 400 nm to about 700 nm. Above-incorporated U.S. patent application Ser. No. 13/048,427 describes some specific techniques for operating a multi-channel luminaire to identify and produce the spectral distribution 650 that approximates daylight spectral distribution 630.

Figure 6C:
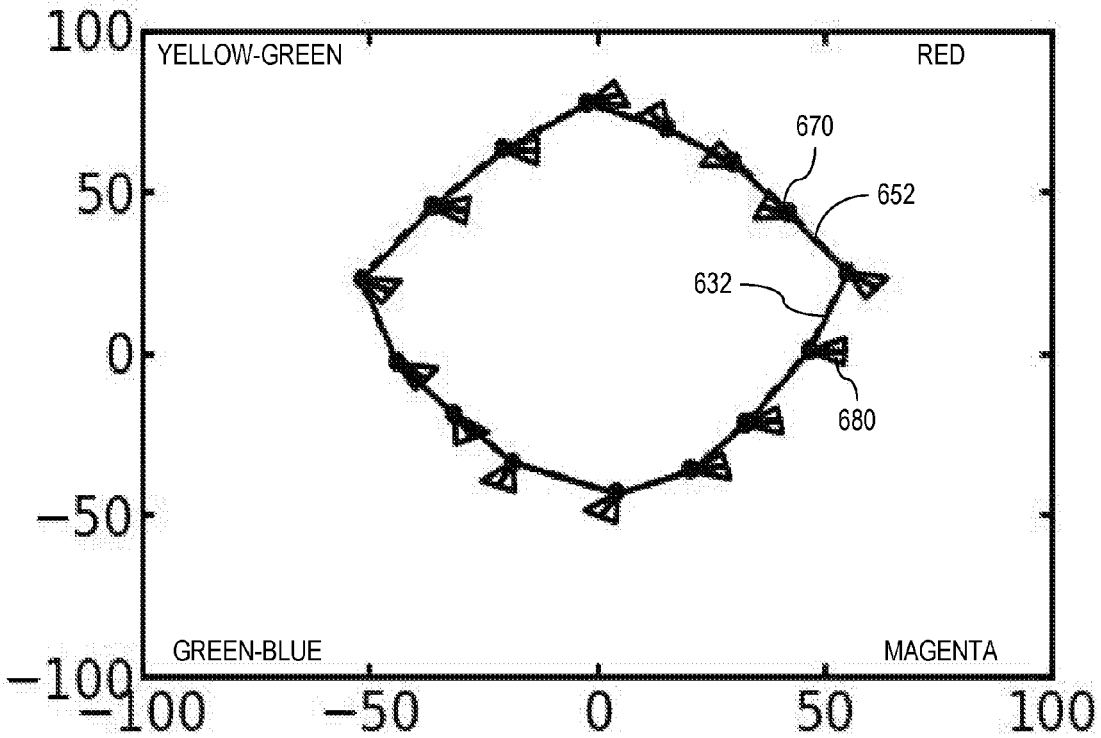
FIG. 6C shows plots and color points in La*b* space associated with CQS samples under the synthesized and target spectral power distributions of FIG. 6B.

One method for determining how well spectral distributions 650 matches spectral distribution 630 is to measure the apparent color of objects illuminated by the two spectral distributions 650 and 630. FIG. 6C shows an (x,y) color space diagram representing thirty La*b* color points 670 corresponding to fifteen CQS color samples under daylight 630 and synthesized light 650. The fifteen points 670 corresponding to daylight 630 are connected to form a color rendering curve 632, and the fifteen points 670 corresponding to synthesized light 650 are connected to form a color rendering curve 652. On the scale of FIG. 6B, curves 662 and 672 are nearly indistinguishable, but each vector arrow 680 shows a difference between color points 670 of a corresponding CQS color sample under 5800° K daylight 630 and a color point of the same CQS color sample under synthesized light 650. In the illustrated case, vectors 680 are short compared to the extent of curves 632 and 652.

Figure 7A:
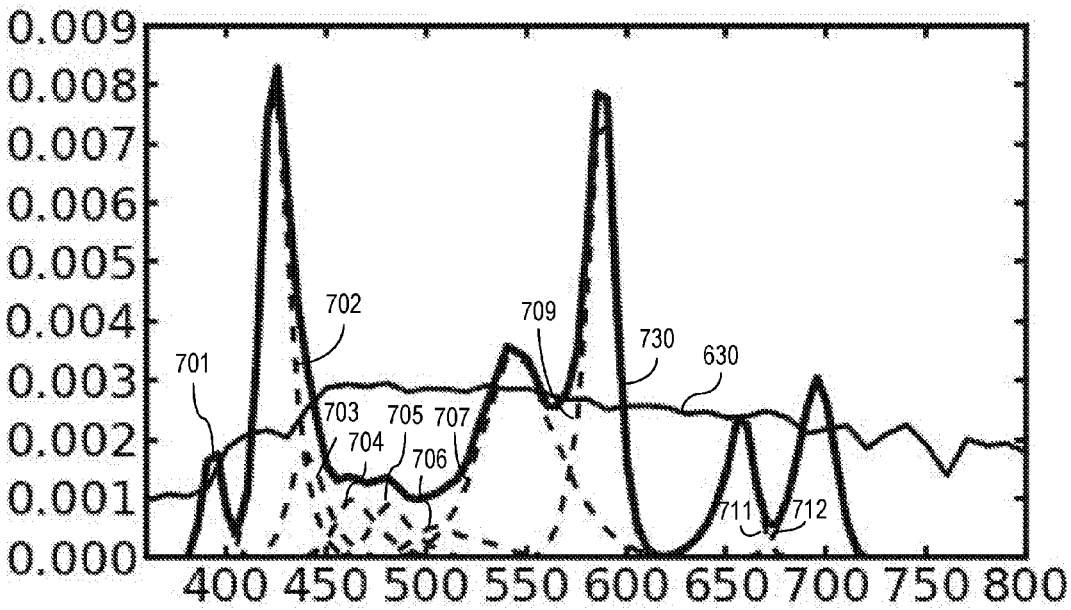
FIG. 7A shows a base or target spectral power distribution and a synthesized spectral power distribution synthesized to decrease the color saturation of green objects.
Figure 7B:
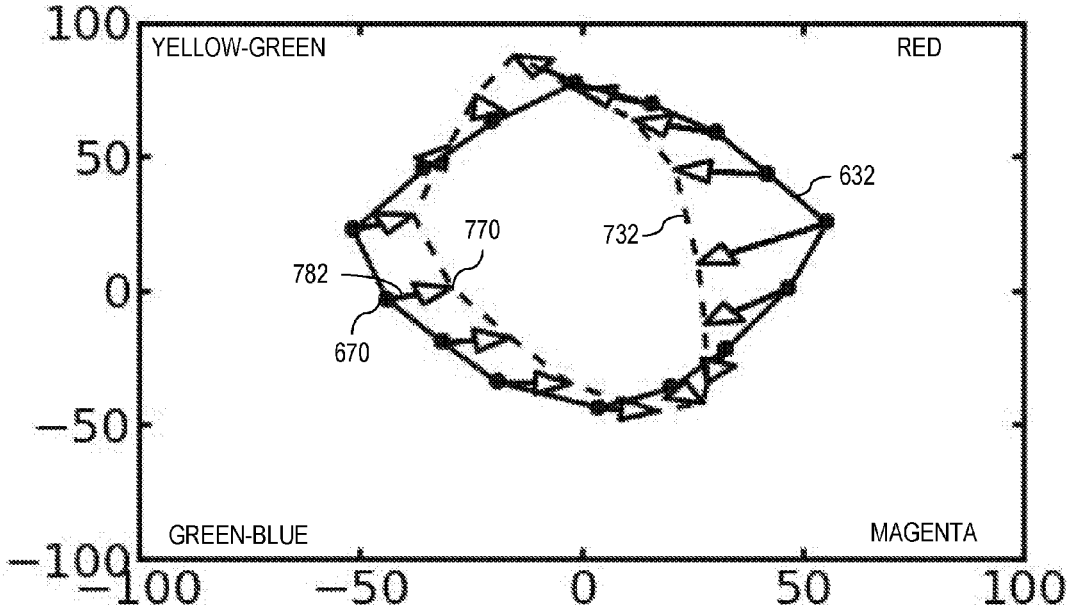
FIG. 7B shows plots and color points in La*b* space associated with CQS samples under the synthesized and target spectral power distributions of FIG. 7A.

A luminaire having more than three color channels often has considerable flexibility in selecting a combination of intensities of the separate color channels that will achieve a particular overall color. For example, a luminaire having twelve color channels with separate spectral distributions peaked at color points 601 to 612 of FIG. 6A can vary the relative intensities emitted by the color channels and still provide a synthesized spectral distribution corresponding to the color point 620 of daylight 630. FIG. 7A shows component spectral distributions 701 to 712 from a 12-channel luminaire that emits a combined spectral distribution 730 having a color point and total intensity that acceptably matches the color point of 5800° K daylight spectral distribution 630, but spectral distribution 730 may be chosen to differ from daylight 630 in a manner selected according to one or more measurement of light reflected from one or more objects. Spectral distribution 730 in this example can be selected to decrease saturation of red and green objects. FIG. 7B particularly shows a (x,y) color space diagram illustrating how color a curve 732 containing fifteen point 770 corresponding to the colors of fifteen CQS color samples under synthesized light 730 differs from a curve 632 containing fifteen point 670 corresponding to the colors of the same fifteen CQS color samples under 5800K daylight 672. In particular, a difference vector 782 that corresponds to a green color sample is directed toward the white point in the center of curves 632 and 732, which means that the appearance of a green object is less saturated under synthesized light 730 than under daylight 630, even though spectral distributions 630 and 730 correspond to white light of the same color temperature. Similarly, a vector 784 indicates that red objects would also appear less saturated under synthesized light 730 than daylight 630.

Figure 8A:
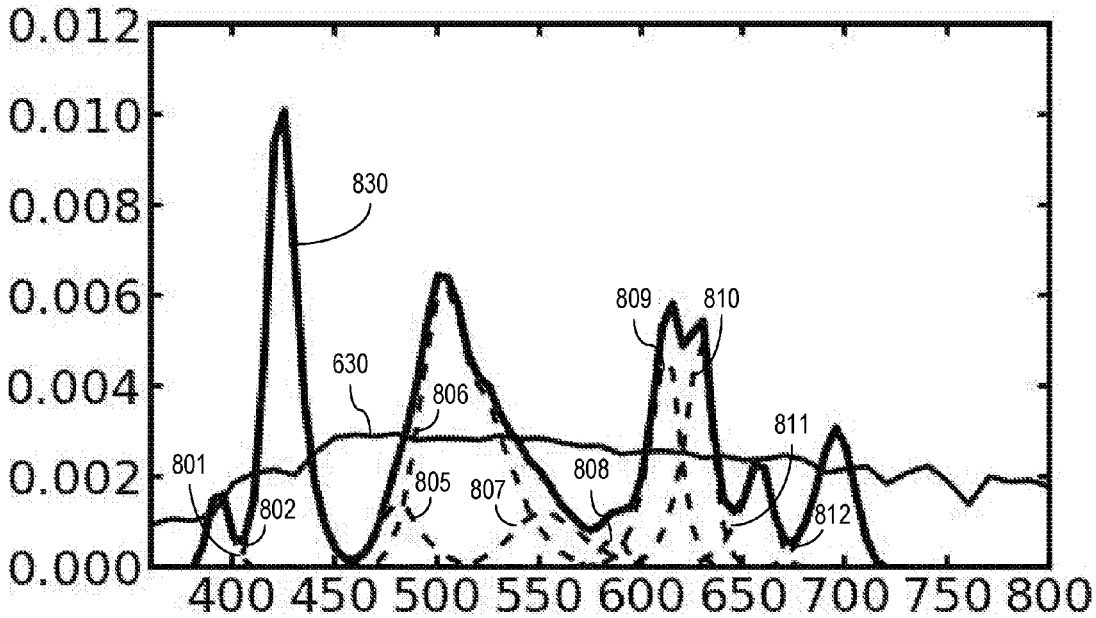
FIG. 8A shows a base or target spectral power distribution and a synthesized spectral power distribution synthesized to increase the saturation of green objects.
Figure 8B:
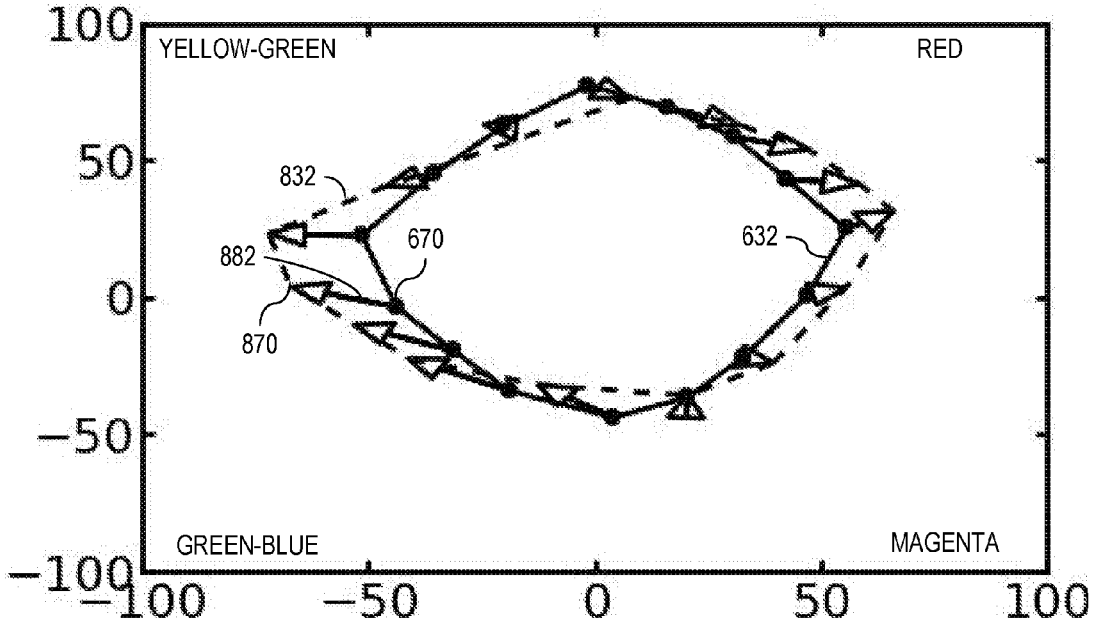
FIG. 8B shows plots and color points in La*b* space associated with CQS samples under the synthesized and the target spectral power distributions of FIG. 8A.

FIG. 8A shows a spectral distribution 830 that synthesized according to the goal of maximizing saturation of green objects. In particular, the relative intensities of component spectral distributions 801 to 812 may be selected according to the goals of maintaining the color temperature and intensity of daylight spectral distribution 630 and the goal of increasing or maximizing the saturation of a green object. FIG. 8B shows a (x, y) color space diagram include curve 632 that connects the color points 670 of fifteen CQS color samples under 5800K daylight 630 and a curve 832 that connects the color points 870 of the same fifteen CQS color samples under synthesized light 830. Curves 632 and 832 are approximately centered on the same color point, showing that synthesized light 839 acceptably matches color point 5800° K daylight spectral distribution 630, but color rendering curve 832 in La*b* diagram of FIG. 8B is very different from curve 632. In particular, a difference vector 882 between points 670 and 870 corresponding to a green object is directed away from the center of diagram 632 and 832, which means that the appearance of a green object will be more saturated under synthesized light 830 than under daylight 630.

The goals described above that are related to producing synthesized light that maintains specific properties such as the color temperature of daylight while providing the synthesize light that increases or decreases saturation of particular objects is just an example. Such systems are particularly desirable in uses where the environment has general lighting characteristics that are desired and lighting requirements that may vary depending on objects that may be involved with the environment. In general, in a lighting system having a light sensor as described above the goals for synthesized light from a multi-channel luminaire may include one or more goal that is selected according to a measured spectral distribution alone or along with one or more goal that is independent of measured spectral distribution.

Possible advantageous uses of luminaire 100 and process 500 described above include scene illumination in retail or in entertainment where specific objects can be made to stand out more clearly from the background, blend into the background, be more appealing, or be less appealing. Another possible use may be in horticulture, where different spectral compositions of light are efficient for different stages of plant growth. In particular, luminaire 100, when used in farming, may alter the spectral content of emitted light in response to a sensing unit that is specialized to identify important stages of plant growth. The sensing unit may provide information on the development stage of the plant, by any suitable method, for example: by using camera to capture images of the plants, processing images, so that controller 120 can synthesize illumination that is most efficient for promoting growth in the detected stage of development.

Some embodiments of the above invention can be implemented in a computer-readable media, e.g., a non-transient media, such as an optical or magnetic disk, a memory card, or other solid state storage containing instructions that a computing device can execute to perform specific processes that are described herein. Such media may further be or be contained in a server or other device connected to a network such as the Internet that provides for the downloading of data and executable instructions.

Although the invention has been described with reference to particular embodiments, the description is only an example of the invention's application and should not be taken as a limitation. Various adaptations and combinations of features of the embodiments disclosed are within the scope of the invention as defined by the following claims.

What is claimed is:

1. A lighting system comprising:

a plurality of light sources respectively having different emission spectra;

a sensing unit configured to measure a spectral content of light reflected from an object in an environment that the lighting system illuminates; and a control system coupled to receive from the sensing unit a measurement of the light reflected from the object, wherein the control system is configured to select respective intensities for emissions from the light sources based on the measurement of the light reflected from the object and is coupled to independently control the light sources to emit the respective intensities.

2. The system of claim 1, wherein the light sources comprise light emitting diodes.

3. The system of claim 1, wherein the sensing unit comprises a light sensor including a device selected from a group consisting of a spectrometer, a colorimeter, a plurality of photodiodes configured to detect different light spectra, and camera.

4. The system of claim 1, wherein the sensing unit comprises an optical element positioned away from the light sources.

5. The system of claim 1, wherein the sensing unit comprises an optical element positioned in proximity to the light sources.

6. The system of claim 1, wherein the control system selects the respective intensities to alter color saturation of the light reflected from the object.

7. The system of claim 6, wherein the control system selects the respective intensities to minimize or maximize color saturation of the light reflected from the object.

8. The system of claim 1, wherein the control system selects the respective intensities according to an aesthetic judgment of an appearance of the object.

9. The system of claim 1, wherein the control system selects the respective intensities to supplement one or more other sources of lighting for an environment illuminated by the lighting system.

10. The system of claim 9, wherein the control system selects the respective intensities to achieve a desired color temperature for the environment illuminated by the lighting system and the other sources of lighting.

11. The system of claim 1, wherein the sensing unit comprises one of a camera, a spectrometer, or a plurality of filtered photo-detectors positioned to measure the spectral content by sensing of scene colors from an image of the environment that the sensing unit captures.

12. The system of claim 1, wherein the control system selects the respective intensities by selecting from a plurality of stored scripts a selected script that corresponds to the measurement.

13. A lighting method comprising:

measuring a first spectral content of light reflected from a first object in a scene;

using a measurement of the first spectral content in selecting a spectral distribution; and adjusting operating parameters of a luminaire that illuminates the scene so that an illumination of the scene matches the spectral distribution selected.

14. The method of claim 13, further comprising measuring second spectral content of light reflected from a second object in the scene, wherein selecting the spectral distribution further comprises using a measurement of the second spectral content in the selecting of the spectral distribution.

15. The method of claim 13, wherein selecting the spectral distribution comprises altering a current spectral distribution of light emitted from the luminaire to alter color saturation of the first object when illumined by the spectral distribution selected.

16. The method of claim 13, wherein selecting the spectral distribution comprises selecting the spectral distribution according to an aesthetic judgment of an appearance of the object when illuminated by the spectral distribution selected.

17. The method of claim 13, wherein selecting the spectral distribution comprises selecting the spectral distribution to supplement one or more other sources of lighting for an environment illuminated by the lighting system.

18. The method of claim 13, wherein the luminaire comprises a plurality of light sources respectively having different emission spectra, and wherein adjusting operating parameters of the luminaire comprises independently controlling respective intensities for emissions from the light sources so that the illumination of the scene matches the spectral distribution selected.

19. The method of claim 13, wherein measuring the first spectral content comprises capturing an image of the scene and sensing of scene colors.

20. The method of claim 13, wherein:

using the measurement of the first spectral content comprises selecting from a plurality of stored scripts a selected script that corresponds to the measurement; and adjusting the operating parameters of the luminaire comprises playing the selected script using the luminaire.

21. A lighting system comprising:

a plurality of light sources respectively having different emission spectra;

a sensing unit configured to measure spectral content of light in an environment that the lighting system illuminates; and a control system coupled to receive from the sensing unit a plurality of measurements respectively of a plurality of light spectra in the environment, wherein the control system is configured to select respective intensities for emissions from the light sources based on the plurality of measurements and is coupled to independently control the light sources to emit the respective intensities.

22. The system of claim 21, wherein the plurality of measurements includes a plurality of measurements of respective apparent colors of a plurality of objects.

23. The system of claim 21, wherein the plurality of measurements includes a plurality of measurements of scene colors from an image of the environment that the sensing unit captures.

24. The system of claim 21, wherein the plurality of measurements includes a measurement of spectral content of ambient light in the environment.

* * * * *